US008011043B2

(12) United States Patent
Graebe et al.

(10) Patent No.: US 8,011,043 B2
(45) Date of Patent: Sep. 6, 2011

(54) MOLDED SEAT CUSHION WITH INTERNAL SHAPE MATCHING ISCHIAL STRUCTURES

(75) Inventors: Robert H. Graebe, Fort Lauderdale, FL (US); Dennis L. Clapper, Swansea, IL (US)

(73) Assignee: Roho, Inc., Belleville, IL (US)

( * ) Notice: Subject to any disclaimer, the term of this patent is extended or adjusted under 35 U.S.C. 154(b) by 172 days.

(21) Appl. No.: 12/467,668

(22) Filed: May 18, 2009

(65) Prior Publication Data

US 2009/0217457 A1 Sep. 3, 2009

Related U.S. Application Data

(63) Continuation-in-part of application No. 12/177,255, filed on Jul. 22, 2008, now Pat. No. 7,681,264, which is a continuation of application No. 11/707,378, filed on Feb. 16, 2007, now Pat. No. 7,424,761.

(60) Provisional application No. 61/082,861, filed on Jul. 23, 2008, provisional application No. 61/099,765, filed on Sep. 24, 2008.

(51) Int. Cl.
*A47C 27/16* (2006.01)

(52) U.S. Cl. ..... 5/653; 5/652; 5/706

(58) Field of Classification Search ..... 5/706, 247, 5/652, 655.3, 653

See application file for complete search history.

(56) References Cited

U.S. PATENT DOCUMENTS 2,433,012 A 12/1947 Zalicovitz
3,605,145 A 9/1971 Graebe
3,720,966 A 3/1973 Zysman
4,005,236 A 1/1977 Graebe
4,541,136 A 9/1985 Graebe (Continued)

FOREIGN PATENT DOCUMENTS

FR 1495351 9/1966

(Continued)

OTHER PUBLICATIONS

PCT/US2009/044319 Written Opinion of the International Searching Authority.

(Continued)

*Primary Examiner* — Frederick Conley
(74) *Attorney, Agent, or Firm* — Polster Lieder Woodruff & Lucchesi, L.C.

(57) ABSTRACT

A cushion 302 comprising a molded foam base 302 with an array of individual suspension elements 306 at the ischial area of the cushion. In one aspect the array of suspension elements is in a recess 307 in the top of the base and in another aspect the array of suspension elements is in an inner cavity 406 defined by the base. The suspension elements are arranged in a pattern wherein the longitudinal axis of each suspension element in the array is positioned at a right angle or parallel to the longitudinal axes of the adjacent suspension elements. Each suspension element has a displaceable load-bearing surface 14, a first end wall 20, a second end wall 22, and an optional bottom wall 30, with load-bearing surface and recited walls defining an inner chamber. The material thickness of the load-bearing surface generally is greater than the material thickness of the end walls whereby the end walls deflect outwardly toward the load-bearing surfaces of adjacent support elements under load. The load-bearing surface can have a substantially arch-shaped, elliptical or rectangular cross-section.

20 Claims, 8 Drawing Sheets

U.S. PATENT DOCUMENTS

| | | | | |
|---|---|---|---|---|
| 4,605,582 | A | | 8/1986 | Sias et al. |
| 4,673,605 | A | * | 6/1987 | Sias et al. ..... 428/120 |
| 4,713,854 | A | | 12/1987 | Graebe |
| D294,212 | S | | 2/1988 | Sias et al. |
| 5,052,068 | A | | 10/1991 | Graebe |
| 5,111,544 | A | | 5/1992 | Graebe |
| 5,152,023 | A | | 10/1992 | Graebe |
| D336,198 | S | | 6/1993 | Gibbons |
| 5,461,741 | A | | 10/1995 | Graebe |
| 5,596,781 | A | | 1/1997 | Graebe |
| 5,613,257 | A | | 3/1997 | Graebe |
| 5,621,934 | A | * | 4/1997 | Olkkonen et al. ..... 5/710 |
| 5,749,111 | A | | 5/1998 | Pearce |
| 5,845,352 | A | | 12/1998 | Matsler et al. |
| 5,994,450 | A | | 11/1999 | Pearce |
| 6,026,527 | A | | 2/2000 | Pearce |
| 6,413,458 | B1 | | 7/2002 | Pearce |
| 6,487,738 | B1 | | 12/2002 | Graebe |
| 7,424,761 | B1 | | 9/2008 | Graebe |
| 2005/0017565 | A1 | | 1/2005 | Sprouse, II |
| 2005/0151410 | A1 | | 7/2005 | Sprouse, II |
| 2005/0223667 | A1 | | 10/2005 | McCann et al. |

FOREIGN PATENT DOCUMENTS

| | | | |
|---|---|---|---|
| FR | 2772261 | A1 | 12/1997 |

OTHER PUBLICATIONS

PCT/US2009/044319 International Search Report.
PCT/US2009/044319 Notification of Transmittal of the International Serach Report and . . . .
Supplementary European Search Report; May 10, 2011.

* cited by examiner

MOLDED SEAT CUSHION WITH INTERNAL SHAPE MATCHING ISCHIAL STRUCTURES

CROSS REFERENCE TO RELATED APPLICATIONS

This application claims the benefit of provisional application Ser. No. 61/082,861, filed Jul. 23, 2008 and provisional application Ser. No. 61/099,765, filed Sep. 29, 2008, and is a continuation-in-part of application Ser. No. 12/177,255, filed Jul. 22, 2008, which is a continuation of application Ser. No. 11/707,378, filed Feb. 16, 2007, now U.S. Pat. No. 7,424,761, all of which are incorporated herein by reference.

BACKGROUND OF THE INVENTION

The invention relates generally to support surfaces that facilitate blood flow and prevent tissue breakdown and more particularly to a molded foam cushion having suspension elements, particularly under the ischial area, that are shaped and positioned to form a shape matching support surface that has relatively uniform restoring forces when deformed under loads from of a user.

Individuals confined to sitting, for example in a wheelchair run the risk of tissue breakdown and the development of ischemic induced sores, which are extremely dangerous and difficult to treat and cure. For example, when seated much of the individual's weight concentrates in the region of the ischia, that is, at the bony prominence of the buttocks, and unless frequent movement occurs, the flow of blood to the skin tissue in these regions decreases to the point that the tissue breaks down. When lying down, the hip region may protrude deeper into the mattress than the adjoining waist or thigh regions and as a consequence the supporting forces exerted by the mattress would be greater at the hips than at the thighs or waist, for example. Any skin area where there are sustained deformation experiences reduced blood flow and the skin does not receive sufficient oxygen and nutrients.

It is desirable to have a support cushion applies generally uniform supporting forces, that is, a generally uniform counter force on the tissue of the ischial area of user positioned on the cushion. When a cushioning structure is deformed while supporting a person it is desirable to have a constant restoring force that exerts equal forces over a broader area of the body minimizing deformation of the soft tissues and help prevent skin and tissue breakdown by facilitating blood flow in the contacted area.

SUMMARY OF THE INVENTION

One aspect of the cushion includes an array of suspension elements positioned at the ischial area of a seated user.

One aspect of the cushion includes a cushion base with an array of suspension elements positioned at the ischial area of a seated user.

One aspect of the cushion includes a cushion base with an array of suspension elements in a recess in top of the cushion base.

One aspect of the cushion provides for a cushion base with an internal cavity and an array of suspension elements in the cavity.

Generally the base is molded foam and, in one aspect, can have leg troughs and central pommel.

Each suspension element has a displaceable, load-bearing surface, a first end wall, a second end wall, and an optional bottom wall. The load bearing surface, end walls and bottom wall, if present, define an inner chamber. The material thickness of the load-bearing surface is greater than the material thickness of the end walls so that the end walls can distend outwardly when force is applied to said load-bearing surface. The optional bottom wall has a vent opening formed therein of a predetermined size that allows controlled release of air from the chamber when force is applied to the load bearing surface to control collapsing of the cell.

The surface of the cushion is displaceable that, when deformed, the suspension elements exert a restoring force that is generally constant irrespective of the extent of the deflection. The cushion applies distributed supporting pressure against an irregularly contoured body areal, such as the ischium, supported on the cushion.

In one aspect of the cushion the array of suspension elements is arranged in a pattern wherein the longitudinal axis of each suspension element is positioned at a right angle relationship to the longitudinal axis of the adjacent suspension elements. The right angle axis position of the suspension elements improves stability imparted to the user.

In another aspect of the cushion the axes of adjacent suspension elements are aligned to maintain shape-fitting performance.

In one aspect of the cushion the load-bearing surface has a generally arch-like cross-sectional configuration to facilitate a controlled buckling function. In other aspects of the invention the load-bearing surface has a substantially elliptical cross-sectional configuration or a substantially rectangular cross-sectional configuration.

DESCRIPTION OF THE INVENTION

Figure 1:
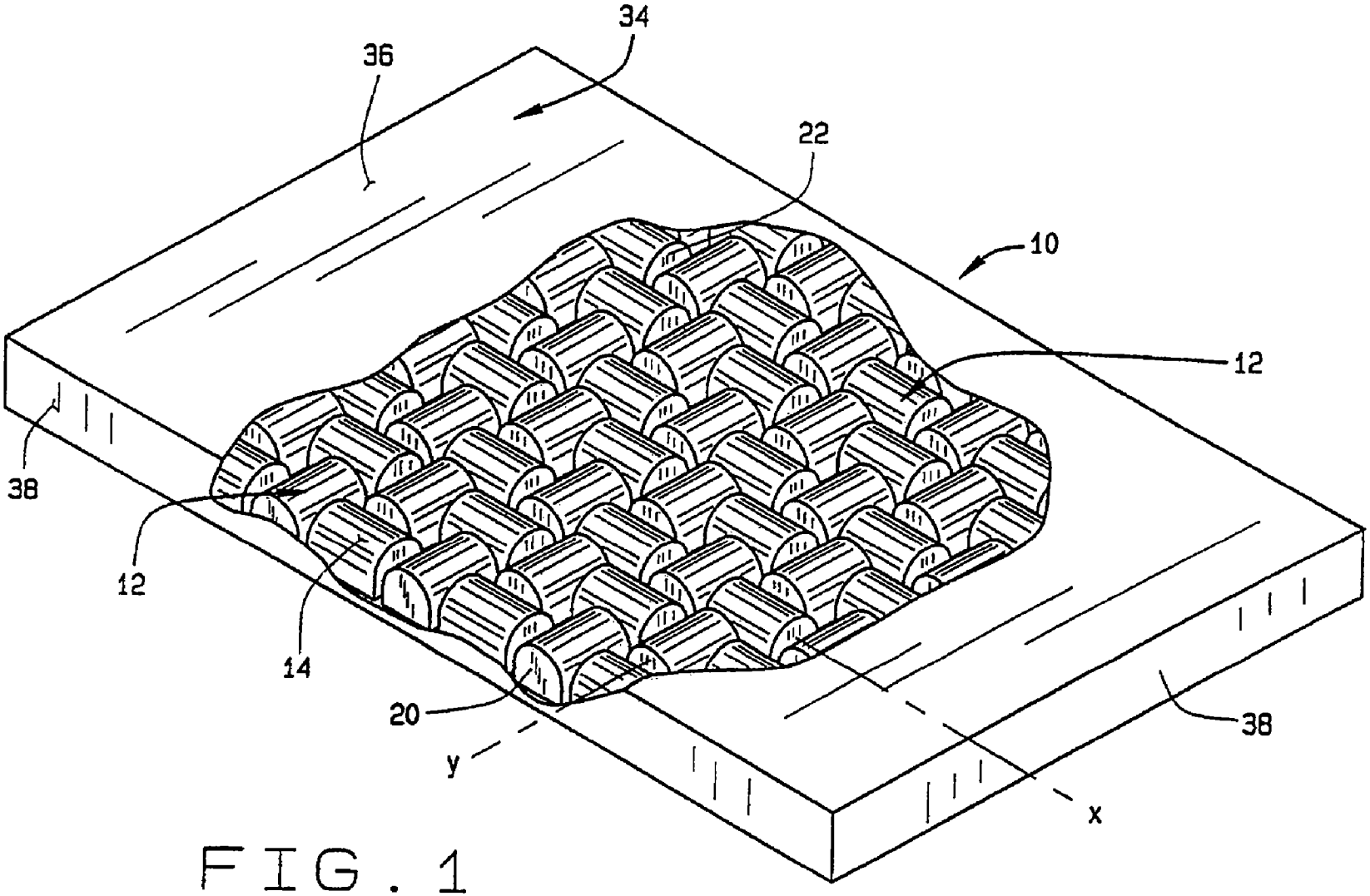
FIG. 1 is a perspective view of one embodiment of a cushion with a cover partially cut away.

Described herein is a cushion that includes an array of suspension elements. In one aspect, the cushion has a molded base with an array of suspension elements positioned at the ischial area of a seated user. In one aspect, the cushion base includes a recess in the top of the molded cushion base with the array of suspension elements positioned in the recess. In another aspect the cushion base includes a cavity with an array of hollow suspension elements in the cavity. The suspension elements create a displaceable constant restoring force, shape-matching surface. The suspension elements include a load-bearing surface, end walls, and an optional bottom wall or membrane that closes off the hollow suspension element. Each bottom wall, when present, has an optional vent of a predetermined size formed therein to allow venting of air from the hollow suspension element when force is exerted on the support surface.

The base of each suspension element generally has rectangular configuration permitting a high density of suspension elements per area or cushion for more contact area to the supported person. The array of suspension elements is arranged in a pattern across the expanse of the cushion wherein the longitudinal axis of each suspension element is positioned at a right angle relationship to the longitudinal axis of the adjacent suspension elements. This results in greater longitudinal stability and effective surface area at the anatomical contact site.

The array of suspension elements creates a cushion that when engaged matches the shape of an object placed thereon with nearly uniform, predetermined counter forces. The size of the vent in the suspension element base wall, or located in a film used to seal the bottom of the suspension element, controls the rate of air flow out of the suspension element and hence allows for damping control of the counter force exerted by the suspension element. The employment of equal counter forces while matching the shape of a person is beneficial in facilitating blood flow in those tissues that are under load. The primary benefit is in minimizing deformation of the vascular network, which provides blood flow to those local tissue cells.

The suspension elements provide a plurality of ways by which the collapse or deformation of the elements and the constant restoring force may be controlled or adjusted. For example, arrangement or position wall thickness, material selection, cross-sectional configuration, the presence or absence of a bottom wall, the size of the opening in the bottom wall, if present, provide for optimal control of the deflection characteristics and constant restoring forces of the array of suspension elements comprising a cushion It will be understood that while reference is made primarily to cushions, the same principles are applied to mattresses and or any other support surface for the proper support and positioning of a user. Hence the term cushion as used in herein and in the appended claims is intended to encompass conventional cushions, wheelchair cushions, mattresses, mattress overlays, heel pads, insoles, chair backs and any other anatomical support structure.

Figure 2:
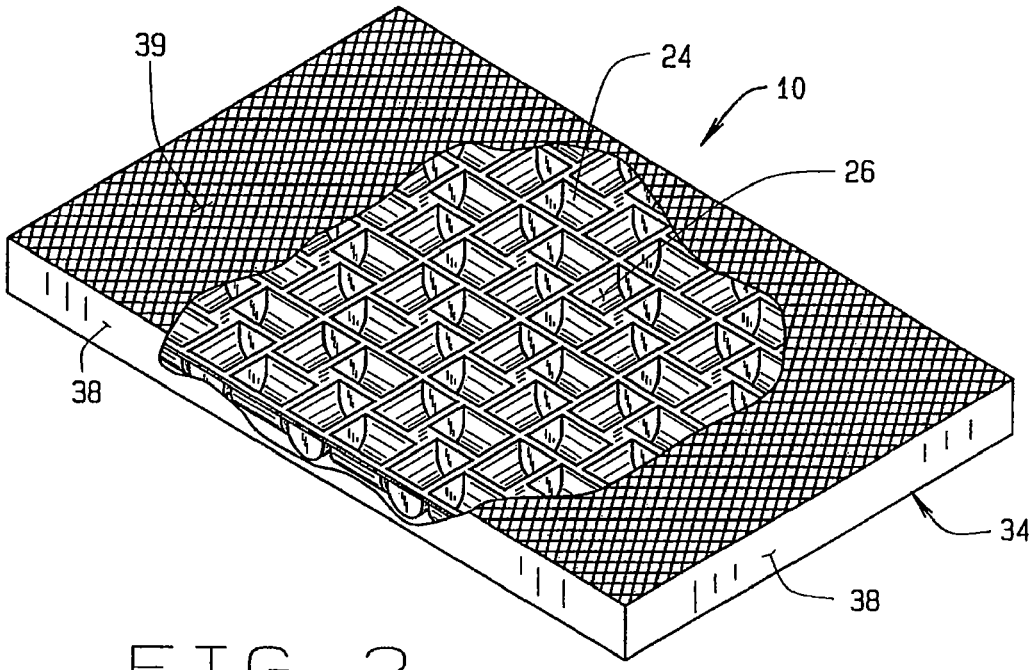
FIG. 2 is a bottom perspective view of the cushion of FIG. 1 without a base and with the openings into the suspension elements exposed.
Figure 3:
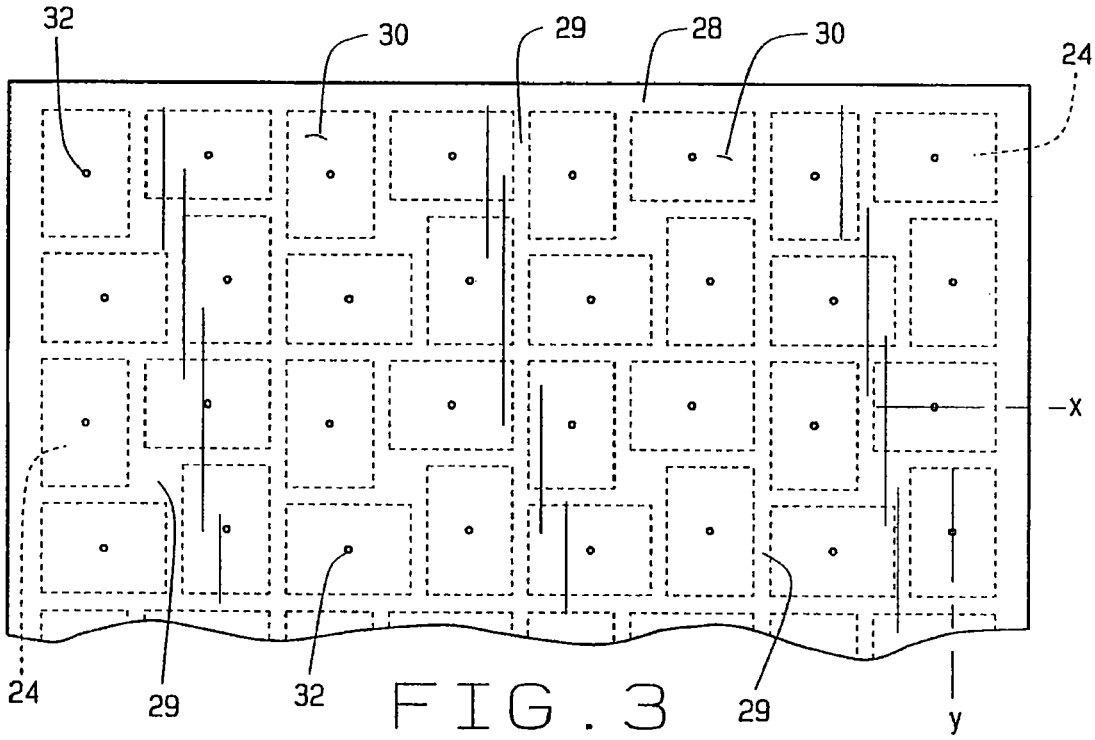
FIG. 3 is a partial bottom plan view of a cushion with the base intact.
Figure 4:
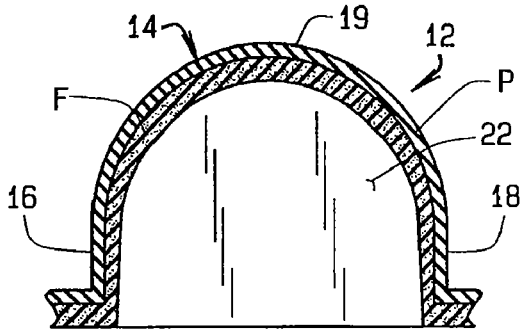
FIG. 4 is a cross-sectional view of a suspension element.
Figure 5:
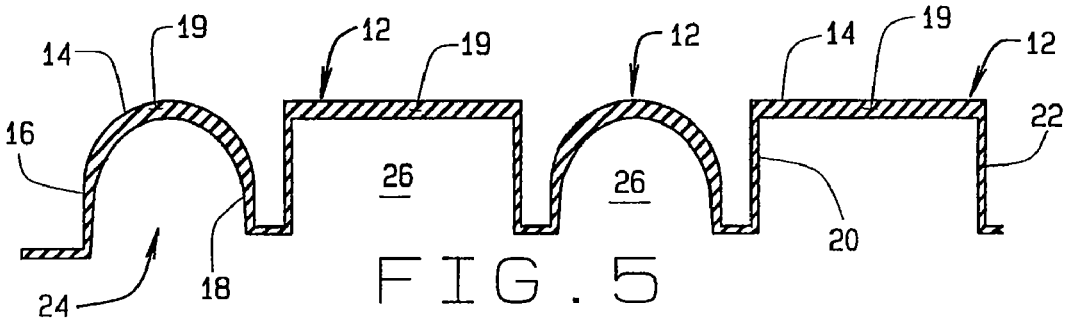
FIG. 5 is a representational cross-sectional view of a partial row of suspension elements from a cushion of FIG. 1.

FIGS. 1 through 5 illustrate one representative embodiment of a cushion, indicated generally by reference numeral 10. Cushion 10 comprises an array of individual suspension elements 12. As seen in FIGS. 4 and 5, the suspension elements 12 have a load-bearing surface 14. The load-bearing 14 surface, in its normal state, has opposed vertical sides 16 and 18 and a top surface 19. The material thickness of the load bearing surface is greatest at the top surface and the thickness decreases or tapers toward the base. That is, the wall thickness of the arch shape becomes less thick. This taper generally occurs when the outside curve of the arch is greater or a different curve, i.e., elliptical, curve from the inside arch. Having a taper will influence the buckling function, which helps to create a constant restoring force, during the range of deflection, as will be described below. The material thickness of the load bearing surface, the taper or both may be adjusted to so as to obtain an optimal buckling or deformation characteristics for any given application.

The suspension element 12 also a first end wall 20 and second end wall 22. The suspension elements are hollow and the load-bearing surface and end walls define an opening 24 and an inner chamber 26. The configuration of each opening 24 of each suspension element is rectangular, which allows for the adjacent placement of multiple suspension elements, side-by-side in rows across the expanse of cushion 10.

As seen in FIG. 4, the cushion can comprise a composite material wherein the suspension elements 12 are constructed from a molded foam F, such as polyurethane or polyethylene foam and the outer surface is a thin polyurethane layer P that creates a smooth, moisture impervious surface. Alternatively, the foam layer F may be covered by a layer P of neoprene or other rubber. Foam material works well and reduces the overall weight of the cushion. In other embodiments, the entire suspension element may be molded from neoprene, with a skin of neoprene to seal the outer surface. Again, the choice of material, i.e. foam, foam and polyurethane composite, neoprene or so forth can be used to obtain desirable deflection or deformation and constant force restoring characteristics.

FIG. 3 illustrates the bottom of one embodiment of a cushion 10 which includes a substantially flat base 28 which forms a base or bottom wall 30 for each of the individual support elements 12. Base 28 can be a continuous web of flexible material, such as polyurethane film P or other membrane-type material, and is adhered to the bottoms of the suspension elements and around opening 24, as at sealed areas 29, so that chamber 26 is enclosed and each suspension element is isolated and discrete and the inner chambers 26 of the suspension elements are not in fluid communication with those of the adjoining suspension elements. The enclosed suspension element is more sanitary than an open structure and more durable. The cushion may be constructed from an array of support elements that have no base or bottom wall and are open on the bottom As seen in FIG. 3, there may be a hole or vent 32 formed in each bottom wall 30. Although shown positioned substantially in the center of bottom wall 30, the vent may be place anywhere in the bottom wall as long as the vent 32 is in fluid communication with chamber 26. The diameter of vent 32 is predetermined so that there is a predetermined rate of airflow out of the chamber of each suspension element, as will be described in more detail below. Positioning of the vent 32 in bottom wall 30 also may affect the rate of airflow out of the suspension elements. The vent 32 controls the rate of expelling the air trapped inside chamber 26 of suspension element 12 and imparts a higher viscosity feel to the cushion than could be provided by mechanical means alone. Controlling the rate of air expulsion is useful in controlling impact forces as may happen within a football helmet, for example. Of course, the suspension elements may have bottom wall 30 that has no hole or vent. Or, a cushion could employ some suspension elements with vents and some without, depending upon the desired effect. Moreover, employment of a bottom wall or no bottom wall is another factor that allows control of the collapsing characteristics of the individual support elements 12.

In any event, the size of vent 32, if one is present, is determined by the dimensions of the suspension element and the volume of chamber 26 so as to impart the desired viscous feel to the cushion as the user is positioned on the cushion. In one representative embodiment, the suspension elements are approximately $1\frac{3}{4}^{th}$ inches long, approximately 1½ inches wide and approximately 1½ inches in height. In this representative embodiment a vent hole of sufficient diameter is used to impart a desired feel through the controlled expulsion of air during seating. Of course, the suspension elements can be of any desired dimensions. The size of the vent 32 can vary to achieve desired support characteristics.

In one embodiment the longitudinal axis x of one suspension element 12 is positioned at a right angle to the longitudinal axis y of the adjacent support element as seen in FIGS. 1 and 3. As best seen in FIG. 4, the end walls 20 and 22 of a suspension element are directed toward the sides 16 and 18 of the load-bearing surfaces 14 of the adjacent suspension elements 12.

Those suspension elements having longitudinal axis x are arranged in a plurality of rows with the axes of the suspension elements in any given row being in rectilinear alignment. Those suspension elements with longitudinal axis y are arranged in a plurality of rows with the axes of the suspension elements in any given row being in rectilinear alignment. Placing each suspension element at right angles to the adjacent suspension elements promotes lateral stability of the individual suspension elements and enhances motion stability for the user positioned on the cushion, as will be discussed below. The cushion can have any number of rows of suspension elements, depending upon the desired size of the cushion.

In the embodiment of FIGS. 1 through 5, the load-bearing surface 14 of each suspension element 12 has an arcuate top surface 19 creating a suspension element 12 having a substantially arch-shaped cross-sectional configuration. The cross-sectional configuration of the support elements affects the compression or deformation characteristics of the suspension element 12 when downward force is applied. For example, when a user is seated on cushion 10, the load or downward force on the support elements will cause the suspension elements to partially compress or deform. Also as seen in FIG. 4, the substantially uniform cross-sectional material thickness of load-bearing surface 14 is greater than the material thickness of the end walls 20 and 22. Control or modification of the relative material thicknesses of the load-bearing surface to the material thickness of the end walls can be used to achieve desirable deformation and restoring force characteristics.

Figure 7:
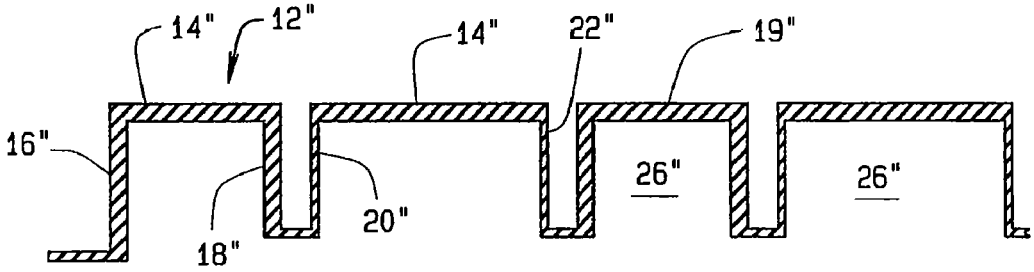
FIG. 7 is a representational cross-sectional view of a partial row of suspension elements having another alternative configuration.
Figure 8:
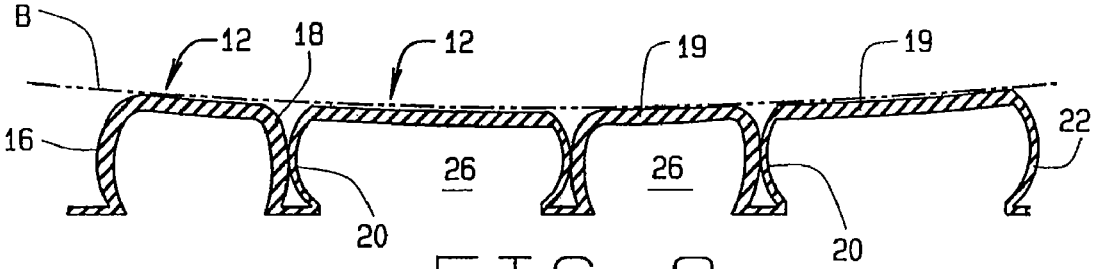
FIG. 8 is a representational cross-sectional view of a partial row of suspension elements of FIG. 4 under load.

As shown in FIG. 7, the load bearing surface 14 is displaceable and vertical sides 16 and 18 may deform and bow outwardly as force is applied to the cushion, for example by a user's body B positioned on the cushion. The air entrapped in chamber 26 is released slowly through vents 32 and, therefore, the remaining air is compressed and causes end walls 20 and 22 to deform and actually to distend outwardly toward to the adjacent support elements 12. This deformation or bowing of the support surface and distension of end walls 20 and 22 is referred to as the deflection travel of the suspension element 12.

Under load, the end walls 20 and 22 abut sides 16 and 18 of the load bearing surface 14 of the adjacent suspension element so that the deformed or deflected suspension elements 12 form a substantially uniform support surface that conforms to the shape of the user's body B. The end walls 20 and 22 provide stability in the deflection travel of the suspension element 12 under load. That is, the cushion will feel more stable to a positioned user due to the reduced deflection travel. Moreover, the restorative force of the deformed suspension elements 12 is nearly constant throughout its deflection travel. the cushion* assumes the shape while exerting a uniform support force on the body B positioned on the cushion to minimize deforming soft tissues which facilitates blood flow.

As seen in FIGS. 1 and 2, the entire cushion can be enclosed in a cover 34. The cover cooperates with the support elements 12 to provide a generally uniform support surface. The cover can have a top panel 36 and side panels 38 made from a stretchy material, such as a stretchy nylon or spandex and a bottom panel 39 made of a tacky or rubberized material or other material having a higher coefficient of friction than the support surface on which the cushion is placed to keep the from sliding. One such cushion cover is disclosed in the inventor's U.S. Pat. No. 5,111,544, which is incorporated herein by reference. Any type of cover that functions appropriately is intended to be within the scope of the invention.

The suspension elements 12 generally are molded in sheets from high density foam using a two-piece mold having a female and matching or different male shape with clearance for developing a suitable wall thickness and shape. Molding the product permits using multiple layers of different materials by using the female side of the mold to first vacuum form a plastic film or form a rubber film by dipping to serve as the top and side that the user would engage. The mold then is filled with foam material. The male side of the mold is inserted. The foam is allowed to cure. The foam can be injection molded if a closed mold is used. The cushion can comprise a combination of a polyurethane outer film with an inner shell of polyethylene or polyurethane foam to produce a more durable structure with improved moisture and abrasion resistance and flex life. The polyurethane film or membrane can form the base 28 of the cushion and, of course, the bottom walls 30 of the suspension elements.

Figure 6:
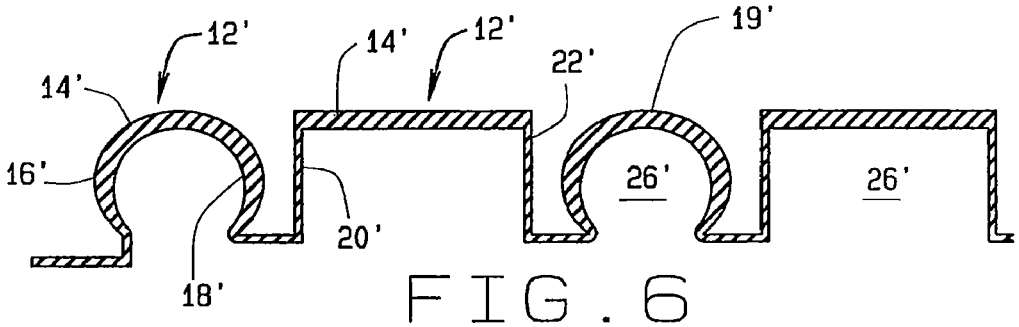
FIG. 6 is a representational cross-sectional view of a partial row of suspension elements having an alternative configuration.

FIGS. 5 and 6 illustrate alternative aspects of suspension elements. As seen in FIG. 5, suspension elements 12' include a load bearing surface 14', side walls 16' and 18', end walls 20' and 22', and a bottom wall (not shown) which define inner chamber 26'. Load bearing surface 14' includes a rounded top surface 19'. It will be appreciated that a cushion constructed of suspension elements 12' may include a bottom wall with a vent, as already explained. Load bearing surface 14' has a substantially ovoid or elliptical cross-sectional configuration with side walls 16' and 18' having substantial curvature. In one aspect, the material thickness of load bearing surface 14' is greater than the material thickness of end walls 20' and 22'. The suspension elements 12' are positioned at right angles to each other as previously discussed.

FIG. 6 illustrates suspension elements 12" having load bearing surface 14" with a substantially vertical side walls 16" and 18" and horizontal, substantially flat top wall 19". Consequently, suspension elements 14" have a substantially rectangular cross sectional configuration. As with the other illustrated designs, suspension elements 12" include end walls 20" and 22" that have a material thickness less than the material thickness of load bearing surface 14". When employed in a cushion, suspension elements 12" could include a vented bottom wall and an inner chamber 26". FIGS. 5 and 6 illustrate that representational embodiments of cushion suspension elements of the present invention can have any acceptable cross-sectional configuration that allow the suspension elements to function in accordance with the broader principles of the invention. Consequently, although three representational embodiments are shown, the scope of the invention and the appended claims should not be limited to any preferred or illustrative embodiments.

Figure 9:
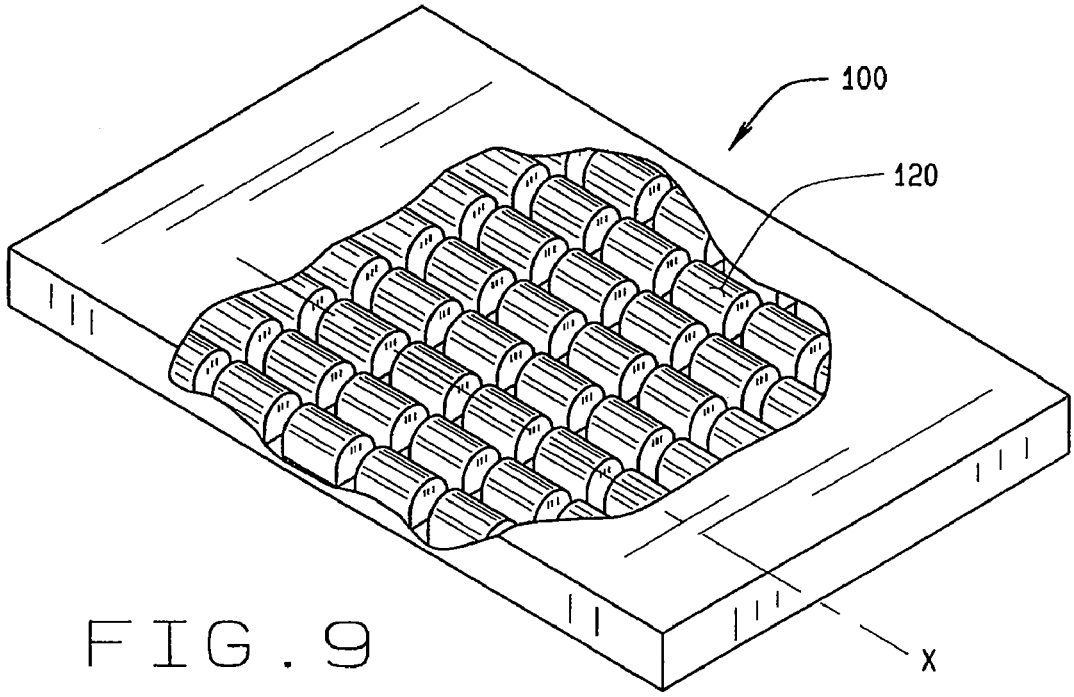
FIG. 9 is a perspective view of another embodiment of a cushion with a cover partially cut away.
Figure 10:
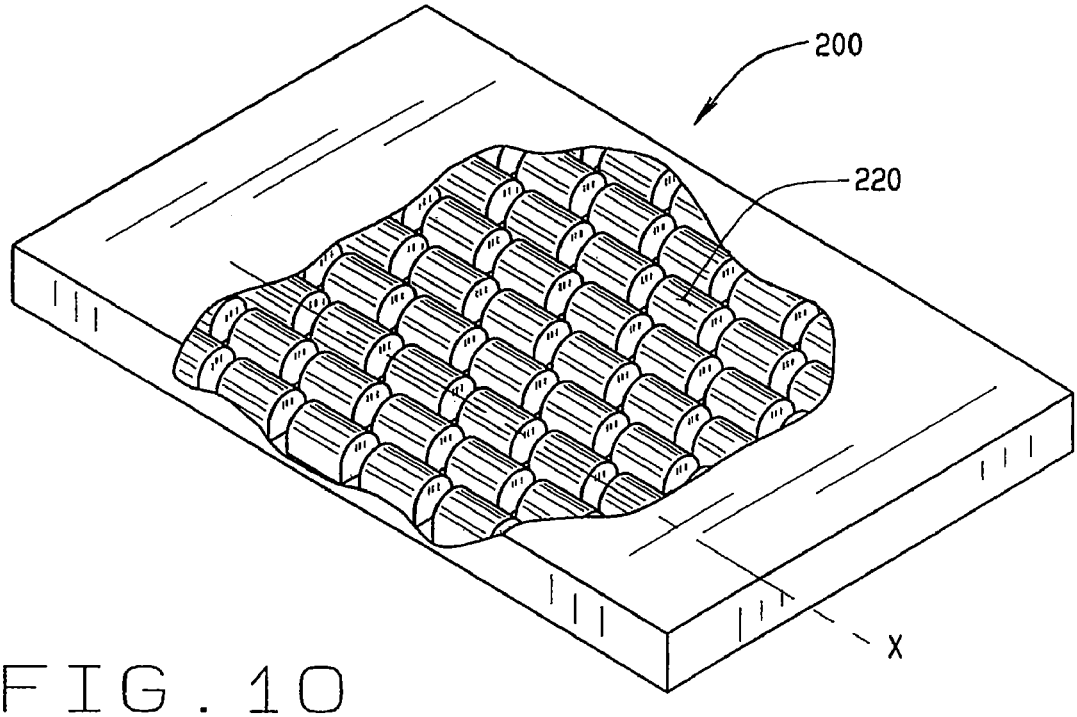
FIG. 10 is a perspective view of another embodiment of a cushion with a cover partially cut away.

FIG. 9 shows an embodiment of a cushion 100 having an array of suspension elements 120 arranged in rows with the longitudinal axes of the suspension elements in each row being in rectilinear alignment. FIG. 10 depicts an embodiment of a cushion 200 having an array of suspension elements 220 arranged in rows with the longitudinal axes of the suspension elements in each row being in rectilinear alignment. The suspension elements 120 and 220 are constructed similar to those described above. However, they are not positioned at right angles.

Cushion 100 provides for axially aligned suspension elements 120 that are positioned side-to-side with the suspension elements in adjacent rows of suspension elements. Cushion 200 provides for axially aligned suspension elements 220 that are off-set or staggered relative to the suspension elements in adjacent rows of suspension elements. The relative positioning of adjacent support elements can influence the deformation and constant restoring force characteristics of the cushions. In the embodiments of FIGS. 9 and 10, those characteristics also can be modified by manipulation of the choice of materials, the material thickness or taper of the load bearing wall, the relative material thickness of the end walls, the use of a bottom wall and the size of the vent in the bottom wall, if present.

Figure 11:
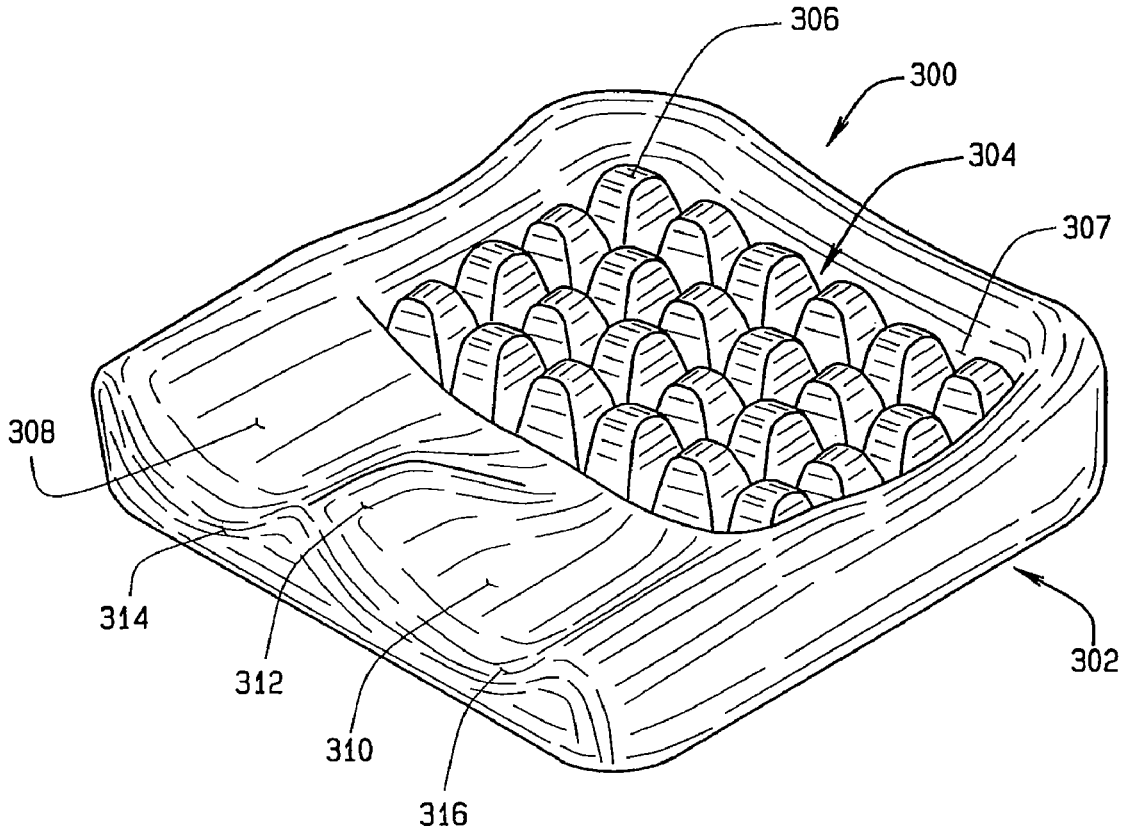
FIG. 11 is a perspective view of another embodiment of a cushion.

FIG. 11 illustrates another aspect of the cushion indicated generally by reference numeral 300. Cushion 300 is a unitary cushion comprising a molded base 302 with an ischial support area 304 comprised of an array of individual suspension elements 306 of the type and function previously described. The array of individual suspension elements is positioned in a recess 307 in the top of the base. Base 302 is contoured and includes a pair of leg troughs 308 and 310 for comfortable lateral support of the seated individual's thighs. There is a pommel 312 between the leg troughs for positioning and support of the thighs. Base 302 includes a relatively low front wall 314 having a radius 316 designed to provide gradual support to the legs. There is no relatively sharp edge or similar pressure point on the forward edge of the base. In generally, base 302 provides for stability and positioning and enhanced seating posture.

As illustrated, individual suspension elements 306 are of the arch-shaped configuration as illustrated in FIGS. 1 through 5. In the illustrated embodiment the longitudinal axes of adjacent cells are arranged at right angles. However, suspension elements 306 can have other appropriate configurations and orientations such as those shown in FIGS. 6 and 7 or any other appropriate configuration.

In the illustrated embodiment base 302 and the array of suspension elements 306 are an integral molded piece, molded from high density foam such as polyethylene or polypropylene foam. There is a smooth transition area 318 between the array of suspension elements and the base to reduce pressure on the legs and thighs of the seated user.

Cushion 300 can be constructed with a bottom wall, particularly under the array of suspension elements. The bottom wall can define individual holes or openings into the inner chambers of the suspension elements for controlled release of air from the chamber when force is applied to said load bearing surface of the individual suspension elements as described above. It would be possible to mold the base and array of suspension elements separately and insert the array of suspension elements into the base at the appropriate located. It could be held in place by a friction fit or sealed or glued or otherwise secured in place.

Figure 12:
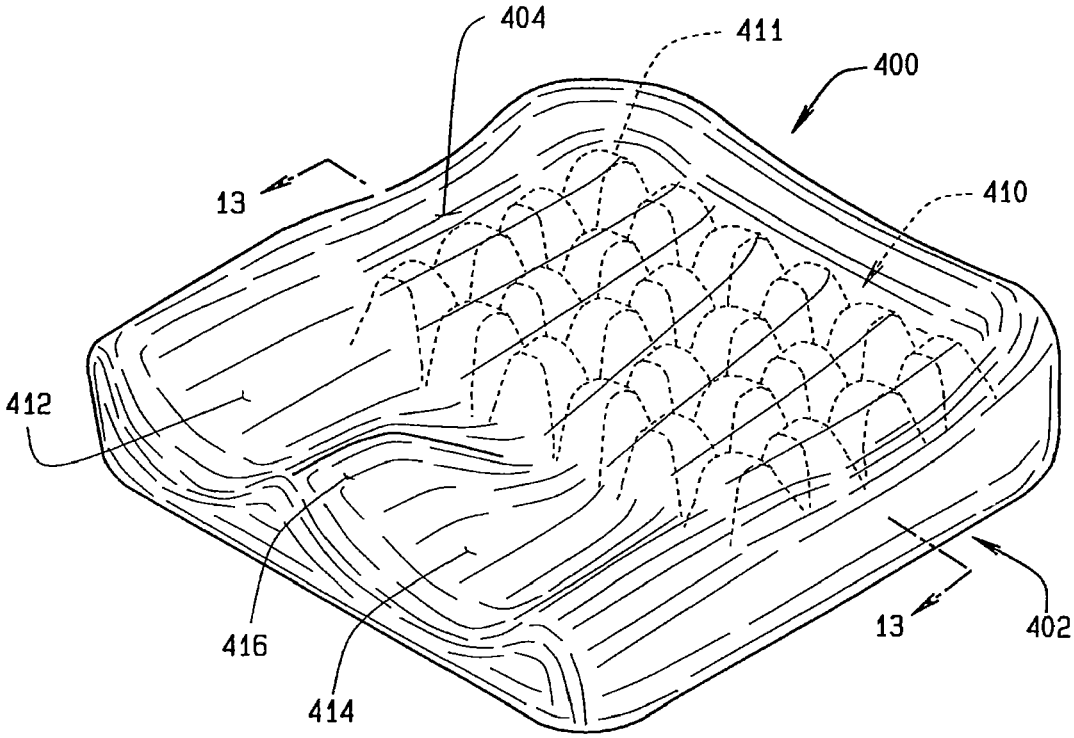
FIG. 12 is a perspective view of another embodiment of a cushion.
Figure 13:
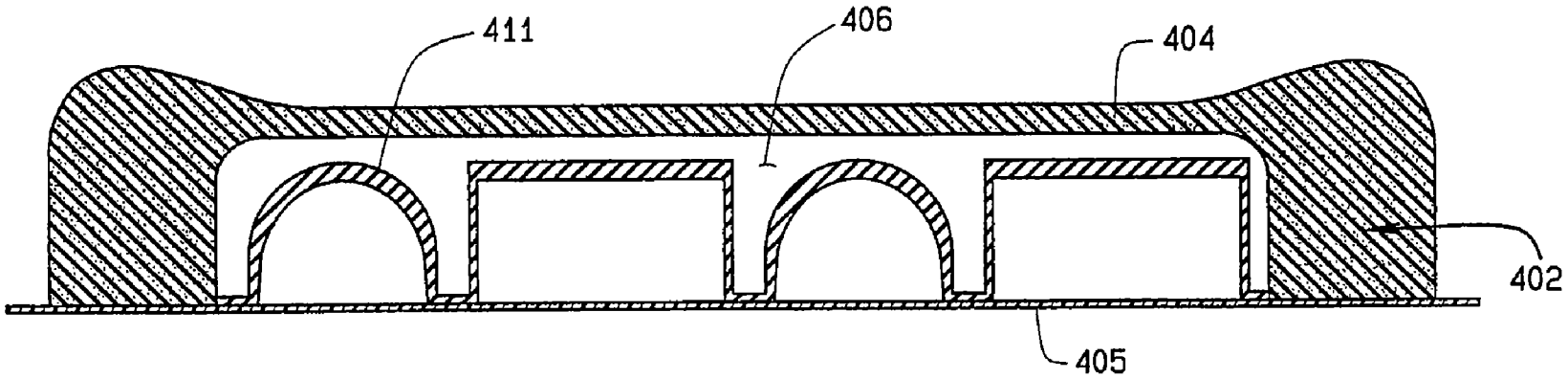
FIG. 13 is a cross-sectional view taken along line 13-13 of FIG. 12.

FIGS. 12 and 13 illustrate another aspect of the cushion indicated generally by reference numeral 400. Cushion 400 is a unitary cushion comprising a molded base 402 having a top surface 404 and bottom wall 405 defining an internal cavity 406. There is a support area 408 comprised of an array 410 of individual suspension elements 411. In the illustrated embodiment, the cavity and support area are located at the approximate ischial area of a seated user. However, cavity 406 could be substantially centrally positioned in the base with the support area extending to areas of the cushion beyond the ischial area.

In any event, base 402, as illustrated, is contoured and includes a pair of leg troughs 412 and 414 for comfortable lateral support of the seated individual's thighs. There is a pommel 416 between the leg troughs for positioning and support of the thighs. A substantially rectangular cushion without leg troughs or pommel is also included within the scope of the invention.

As illustrated, individual suspension elements 411 are of the arch-shaped configuration as illustrated in FIGS. 1 through 5. In the illustrated embodiment the longitudinal axes of adjacent cells are arranged at right angles. However, suspension elements 411 can have other appropriate configurations and orientations such as those shown in FIGS. 6 and 7 or any other appropriate figuration without departing from the scope of the invention. Bottom wall 405 may include holes or vents, such as vents 32 previously described, under each cell to control the flow of air out of the invent. The base is molded foam and the array of suspension elements can be integrally molded in cavity 406 or a separate molded piece inserted into cavity 406. The bottoms of the array of suspension elements form the bottom of the cushion. The bottom wall can have vent holes under each cell, as described above.

Figure 14:
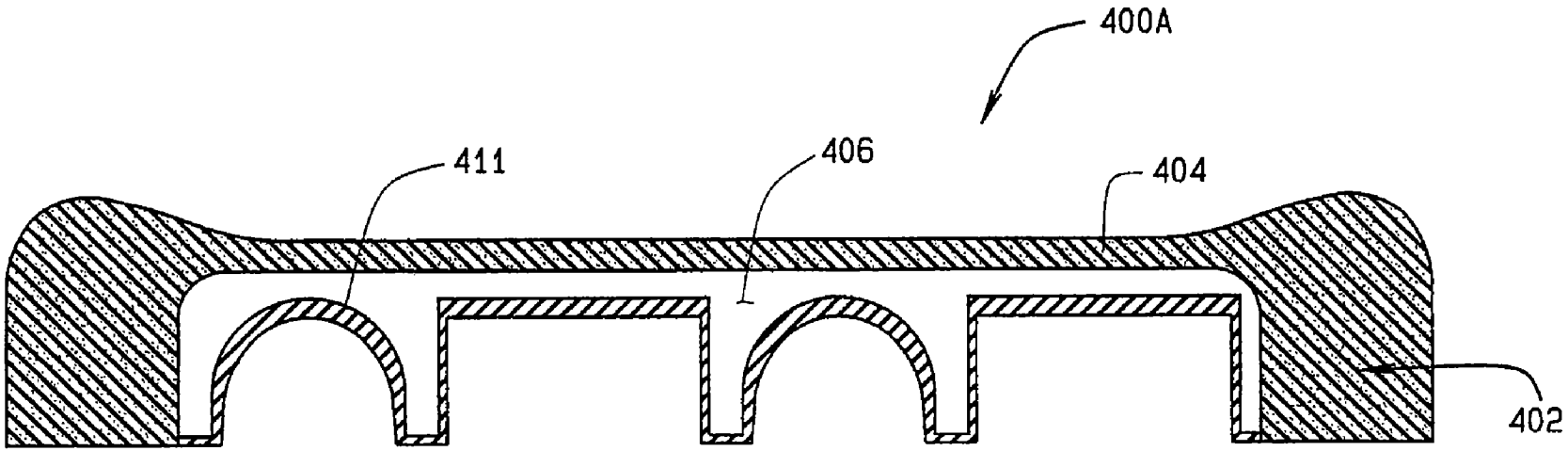
FIG. 14 is a cross-sectional view of another aspect of the cushion.

FIG. 14 shows another aspect of the cushion, indicated generally as 400A. Cushion 400A does not have a bottom wall and the individual cells 411 are open at the bottom. In the embodiments of FIGS. 12-14 the array of suspension elements creates a cushion that when engaged matches the shape of an object placed thereon with nearly uniform, predetermined counter forces even though there is a top layer 404 of cushion between the array of cells and the seated user.

The configurations of cushions 300 and 400 are intended to be illustrative. The shape matching array of cells of the present design may be employed in any cushion, whether it be molded and contoured with leg troughs and pommel, as shown, or simply rectangular or more pillow-shaped. The configuration of the cushion with which the array of shape matching cells is employed is incidental to the invention. Moreover, the foregoing written description and accompanying drawings are intended to be illustrative of the broader aspects of the invention and the best mode of working the invention presently known to the inventor and should not be construed as limiting the scope of the invention as defined by the appended claims.

The invention claimed is:

1. A cushion comprising:

a cushion base; and an array of suspension elements positioned in the cushion base at an approximate ischial area of an individual seated on the cushion;

each said suspension element having a displaceable load-bearing surface, a first end wall at a first end of a longitudinal axis of the displaceable load-bearing surface, and a second end wall at a second end of the longitudinal axis of the displaceable load-bearing surface, said load bearing surface and recited end walls defining an inner chamber, the material thickness of the load-bearing surface being greater than the material thickness of the end walls whereby said ends walls deflect outwardly when force is applied to said load-bearing surface.

2. The cushion of claim 1 wherein the array of suspension elements is in a recess in a top surface of the cushion base.

3. The cushion of claim 1 wherein the array of suspension elements is in a cavity in the cushion base.

4. The cushion of claim 3 wherein the seat base cavity is under a top surface of the seat base.

5. The cushion of claim 1 wherein the seat base further comprises a bottom wall.

6. The cushion of claim 5 wherein the bottom wall includes a vent opening under each suspension element.

7. The cushion of claim 1 wherein said array of suspension elements is arranged in a pattern wherein the longitudinal axis of each suspension element is positioned at a right angle relationship to the longitudinal axis of adjacent suspension elements.

8. The cushion of claim 1 wherein the load-bearing surface has a substantially arch-like cross-sectional configuration.

9. The cushion of claim 1 wherein the load-bearing surface has a substantially elliptical cross-sectional configuration.

10. The cushion of claim 1 wherein the load bearing surface has a substantially rectangular cross-sectional configuration.

11. The cushion of claim 1 wherein the suspension elements comprise high density molded foam.

12. The cushion of claim 1 wherein the load-bearing surface further comprises a top surface and opposed, depending side walls each having a tapered material thickness.

13. A cushion comprising:

a contoured cushion base with forward support areas for lateral support of the legs of a seated user; and an array of suspension elements in the cushion base positioned under an ischial area of the seated user, said suspension elements having a longitudinally extending displaceable load-bearing surface with a top surface and opposed first and second side walls, said first and second side walls each having a material thickness that decreases from the top surface down, a first end wall at a first end of the suspension element, and a second end wall at a second end of the suspension element, said load bearing surface and recited end walls defining an inner chamber, the material thickness of the load-bearing surface being greater than the material thickness of the end walls whereby said ends walls deflect outwardly when force is applied to said load-bearing surface.

14. The cushion of claim 13 wherein the suspension elements further comprise a bottom wall.

15. The cushion of claim 13 wherein said array of suspension elements is arranged in a pattern wherein a longitudinal axis of each suspension element is positioned at a right angle relationship to a longitudinal axis of adjacent suspension elements.

16. The cushion of claim 13 wherein the load-bearing surface has a substantially arch-like cross-sectional configuration.

17. The cushion of claim 13 wherein the suspension elements comprise high density molded foam.

18. The cushion of claim 13 wherein the suspension elements are in a recess in the top of the cushion base.

19. The cushion of claim 13 wherein the suspension elements are in an inner cavity defined by the cushion base.

20. A cushion comprising:

a cushion base; and an array of suspension elements positioned in the cushion base at an approximate ischial area of an individual seated on the cushion, said array of suspension elements arranged in a pattern wherein a longitudinal axis of each suspension element is positioned at a right angle relationship to a longitudinal axis of adjacent suspension elements, each said suspension element having a displaceable load-bearing surface, a first end wall, and a second end wall, said load bearing surface and recited end walls defining an inner chamber, the material thickness of the load-bearing surface being greater than the material thickness of the end walls whereby said ends walls deflect outwardly when force is applied to said load-bearing surface.

* * * * *